US006601648B2

(12) United States Patent
Ebinger

(10) Patent No.: US 6,601,648 B2
(45) Date of Patent: Aug. 5, 2003

(54) WELL COMPLETION METHOD

(76) Inventor: Charles D. Ebinger, 212 Farmington, Lafayette, LA (US) 70503

( * ) Notice: Subject to any disclaimer, the term of this patent is extended or adjusted under 35 U.S.C. 154(b) by 40 days.

(21) Appl. No.: 09/986,212

(22) Filed: Oct. 22, 2001

(65) Prior Publication Data

US 2003/0075326 A1 Apr. 24, 2003

(51) Int. Cl.[7] ..... E21B 43/267

(52) U.S. Cl. ..... 166/297; 166/276; 166/278; 166/308

(58) Field of Search ..... 166/297, 276, 166/308, 278, 280, 281

(56) References Cited

U.S. PATENT DOCUMENTS

| | | | | |
|---|---|---|---|---|
| 4,378,845 | A | | 4/1983 | Medlin et al. |
| 5,115,860 | A | | 5/1992 | Champeaux et al. |
| 5,329,998 | A | | 7/1994 | King et al. |
| 5,373,899 | A | | 12/1994 | Dore et al. |
| 5,492,178 | A | | 2/1996 | Nguyen et al. |
| 5,505,260 | A | | 4/1996 | Andersen et al. |
| 5,623,993 | A | | 4/1997 | Van Buskirk et al. |
| 5,722,490 | A | * | 3/1998 | Ebinger ..... 166/281 |
| 5,845,712 | A | | 12/1998 | Griffith, Jr. |
| 5,865,252 | A | | 2/1999 | van Petegem et al. |
| 5,954,133 | A | | 9/1999 | Ross |
| 5,975,205 | A | | 11/1999 | Carisella |
| 6,003,600 | A | | 12/1999 | Nguyen et al. |
| 6,059,033 | A | | 5/2000 | Ross et al. |
| 6,095,245 | A | | 8/2000 | Mount |
| 6,138,755 | A | | 10/2000 | Swartwout |
| 6,176,307 | B1 | | 1/2001 | Danos et al. |
| 6,206,100 | B1 | | 3/2001 | George et al. |
| 6,220,353 | B1 | | 4/2001 | Foster et al. |
| 6,230,802 | B1 | | 5/2001 | Duhon |
| 6,241,013 | B1 | | 6/2001 | Martin |
| 6,253,851 | B1 | | 7/2001 | Schroeder, Jr. et al. |
| 2002/0189808 | A1 | * | 12/2002 | Nguyen et al. ..... 166/278 |

OTHER PUBLICATIONS

Charles Ebinger, "Rigless frac packs provide cost–effective completions," *World Oil*, Oct. 2000, pp. 68–90.

(List continued on next page.)

*Primary Examiner*—William Neuder
(74) *Attorney, Agent, or Firm*—Kenneth L. Nash

(57) ABSTRACT

An improved method of completing unconsolidated subterranean formations is provided whereby the necessity of expensive high density brine completion fluids is eliminated. Also, the drilling rig time is eliminated or reduced. In one embodiment, the method involves placing a bridge plug below the zone, and displacing drilling mud with a lighter weight completion fluid such as potassium chloride fluid whereby the lighter weight completion fluid does not in itself create a sufficient bottom hole hydrostatic well pressure to control the well. Except for monobore/tubingless completions, a production packer and production tubing string may be placed in the well, if not already in place from a prior completion. The wellhead tree is placed on the well, two subsurface safety valves may be installed in the tubing, and the rig may be released from the wellsite. Sufficient pressure may be applied at the surface to thereby increase the bottom hole hydrostatic pressure to amount sufficient to control the well. The zone is perforated through tubing with an electric line conveyed gun under pressure. A dual-screen (vent-screen) device to control formation sand production is deployed on electric line, braided line, or coiled tubing. The dual-screen device is placed on top of the bridge plug, and the well is Frac Packed, or gravel packed down the tubing. The excess proppant/sand is then flowed from the well, or coiled tubing is used to wash the excess out of the well. The zone is then put on production.

29 Claims, 11 Drawing Sheets

OTHER PUBLICATIONS

Charles Ebinger, "New frac–pack procedures reduce completion costs," *World Oil*, Apr. 1996, pp. 71–75.

I.J. Scott and F.J. Black, *Slim–Hole Sidetrack Cuts Costs by* 50%, SPE European Petroleum Conference, Oct. 1998.

"Monobores Improve Life–Cycle Cost," *JPT*, Feb. 1998, pp. 69–70.

M.S. Macfarlane and P.A. Mackey, *Monobores–Making a Difference to the Life Cycle Cost of a Development*, SPE Asia Pacific Oil & Gas Conference and Exhibition Oct. 1998.

R.T. Rice, G. Navaira, and G. Champeaux, *Through–Tubing Gravel Packs performed by Electric Wireline–Case History*, SPE International Symposium on Formation Damage Control, Feb. 2000.

John R. Sanford, Tamara R. Webb, Seb Patout, Hugo Morales, and Dowell Schumberger, *Utilizing 4.5–in. Monobores and Rigless Completions to Develop Marginal Reserves*, SPE/ICoTA Coiled Tubing Roundtable, May 1999.

* cited by examiner

WELL COMPLETION METHOD

FIELD OF THE INVENTION

The present invention relates to an improved method of completing subterranean zones. More specifically, the present invention provides techniques for performing completions in unconsolidated formations to thereby eliminate the need for expensive high-density completion brines and also reduces/eliminates drilling/workover rig requirements for completion operations.

BACKGROUND OF THE INVENTION

The methods described in this patent may be utilized to perform more productive well completions at significantly reduced costs.

Dual-screen assemblies and Frac Packing techniques are known in the art and have been utilized for oil and gas well completions for a number of years. Exemplary embodiments of dual-screen assembly techniques techniques are taught in my previous U.S. Pat. No. 5,722,490, issued Mar. 3, 1998, which is hereby incorporated herein by reference. My previous patent discloses methods for increasing the production rate from a cased well that might otherwise produce solids through perforations during production. In accord with the methods presented in my previous patent, a gravel pack screen is placed in the well along with equipment in the tubing string to control flow from inside to outside the tubing below a production packer. The rig used for handling the tubing string may then be released from the well. The well is then hydraulically fractured. If the well is producing from a high permeability zone, then the hydraulic fracture is preferably formed with a tip screen-out technique. The method can also be used in a well already containing production tubing without moving a rig onto the well to remove the tubing from the well and can be used in a well not yet perforated by adding tubing-conveyed perforating apparatus below the screen.

It is well known by those of skill in the art that oil and gas wells are drilled with a fluid, called drilling mud, which normally has a density greater than water. Typically, after well logs are run to confirm that commercial zones of hydrocarbons have been encountered along the wellbore, steel casing of various sizes is run into the well. The casing is cemented in the wellbore utilizing cementing techniques well known in the art, and then the completion phase of the well commences.

In many areas of the world, the drilling fluids utilized during drilling may permanently damage the pay zone formation adjacent the wellbore in a manner that reduces the potential production of oil and gas. For this reason, a solids-free completion fluid having a selected density is frequently used to displace the drilling fluid from the wellbore as an initial part of the well completion process. Use of a suitable completion fluid is particularly desirable in high permeability, and unconsolidated, formations found throughout the world.

High-density completion fluids are often necessary in conventional well completions to maintain sufficient hydrostatic pressure to control the bottom hole pressures of the producing zones for relatively higher pressure producing zones. However, high-density completion brines can be very expensive, dangerous to field personnel, and often times damaging to the producing zones. Zinc bromide completion fluid, in the density range of 14–20 pounds per gallon, is particularly expensive and damaging. Nonetheless zinc bromide completion fluid is commonly utilized in the prior art despite these known deficiencies because of a lack of more suitable alternatives. Those of skill in the art have focused upon methods and techniques to eliminate the use of zinc bromide completion fluids for many years. Thus, the present invention provides innovative and low-cost solutions to quite significant technical problems encountered for many years by those of skill in the art of well completions.

The technique of Frac Packing a production zone to bypass the damage created by the drilling fluid, and cementing operations, has become the prevalent completion technique utilized for unconsolidated formations. Frac Packing has replaced gravel packing, and high-rate water packing, as the most efficient means to produce these types of pay zones, without the production of formation sand. Normally, the Frac Pack technique results in the highest completion rates, with the lowest drawdown at the formation/wellbore interface.

The elimination, or time reduction, of the use of a drilling rig or workover rig, or other type of well intervention device, e.g., a coiled tubing unit, has a significant effect on the cost of completing an oil or gas well. The rig time required to perform a conventional well completion on unconsolidated zones can be extensive and costly. As used herein a rig is a device with a high lifting capacity capable of lifting an entire string of tubing or pipe, which may have a length of over several thousand feet in length. The rig also includes pipe-handling means for breaking/making pipe connections as the tubular string is removed and/or inserted into the wellbore. Various types of rigs may include jack-up rigs, masts, workover rigs, upright derricks with traveling blocks, drilling rigs, and the like including associated pipe-handling devices. The cost of the rig, coupled with the use of high-density completion brine, can easily result in a non-economical operation. By eliminating or reducing these costs in accord with the techniques of the present invention, many oil and gas wells may now be profitable to drill and complete that otherwise would not be profitable. Moreover, the present invention has the potential to significantly increase profitability of otherwise profitable wells.

Various inventors have attempted to solve problems related to those discussed above as indicated by the following patents:

U.S. Pat. No. 6,095,245, issued Aug. 1, 2000, to M. J. Mount, discloses a repositionable apparatus for perforating and gravel packing an underground well which uses gravity or other means to reposition the apparatus instead of a conventional wireline or work string attached to a rig. Perforating and packing can be accomplished without a rig after the apparatus is initially placed and set in the well. One embodiment of the inventive apparatus uses a perforating gun assembly, a connected ported sub above the gun assembly, a translating annulus packer above the ported sub, a circumferential screen located above the packer, blank pipe connected above the screen, an openable port above the blank tubular pipe, and a second translating annulus packer attached to the blank tubular.

U.S. Pat. No. 6,253,851, issued Jul. 3, 2001, to D. E. Schroeder, discloses method of completing a well that penetrates a subterranean formation and more particularly to a method for screen placement during proppant packing of formation perforations or fractures created by hydraulic fracturing techniques. The top of the screen is placed at a sufficient distance below the top of the perforations such that the frac pack pumping rate does not bridge off at the top of the screen when the frac pack is being pumped.

U.S. Pat. No. 6,003,600, issued Dec. 21, 1999, to Nguyen et al., discloses methods of completing unconsolidated subterranean zones penetrated by wellbores. The methods basically comprise the steps of placing a slotted liner in the zone, isolating the slotted liner and the wellbore in the zone, injecting a hardenable resin composition coated particulate material into the zone by way of the slotted liner and then causing the hardenable resin composition to harden whereby the particulate material is consolidated into a hard permeable uniform mass.

U.S. Pat. No. 5,115,860, issued May 26, 1992, to Champeaux, et al., discloses an apparatus for setting a gravel pack in an oil well through tubing situation and includes the steps of running a tool body into the well using an electric wireline deployment. The tool body is precisely positioned relative to the surrounding casing, and radially extending members attached to the tool are used to extend from the tool body and center the tool body in the well bore. Sand control media such as a gravel pack is disposed in the well annulus circumferentially about the tool body using a dump bailer. The use of radially extending members allows the tool body to pass through restricted diameter areas such as production tubing, fittings, nipples, pressure control device, packers, valves and the like.

U.S. Pat. No. 5,373,899, issued Dec. 20, 1994, to Dore' et al., discloses an invention for controlling a well during completion by first running a sealable well completion tool and string downhole from the surface and isolating a productive interval near an oil or gas formation from the remainder of the wellbore. The drilling or other fluid in the interval is displaced from the interval under control by a non-damaging fluid. Using a pressure source from the surface, the non-damaging fluid is pressurized and circulated to move the gravel to the formation face by fluid entrainment. After the gravel is separated from the entraining fluid to form a gravel pack, the oil or gas formation may now be produced through the gravel pack.

U.S. Pat. No. 5,865,252, issued Feb. 2, 1999, to van Petegem et al., discloses a one-trip production zone perforation and proppant fracturing operation carried out using a workstring-supported perforation gun lowered into a casing nipple located in the production zone. Firing of the gun creates spaced apart aligned sets of perforations extending outwardly through a side wall portion of the workstring, the nipple, the surrounding cement, and into the production zone, after which the gun falls into and is retained in an underlying gun catcher portion of the workstring. While an overpull force is maintained on the workstring above the perforations, a proppant slurry is pumped down the workstring, out its sidewall perforations, and outwardly through the aligned perforation sets formed in the nipple, cement and production zone. After stimulation of the production zone, the workstring and the spent perforation gun that it retains are pulled up, with the upwardly moving workstring positioning a sliding closure device inwardly over the perforations to isolate the stimulated production zone until the well is readied for production. Illustrated alternate embodiments include the use of a low debris casing gun in place of the drop-off type perforating gun, the use of pre-formed wide wall perforations in the workstring side wall, and a one-trip perforation and production flow creating method in which the production zone stimulating step is eliminated.

U.S. Pat. No. 5,975,205, issued Nov. 2, 1999, to J. V. Carisella, discloses a through-tubing gravel packing operation utilizing inflatable packing elements and a flow cross-over assembly which selectively opens flow ports for effecting steps in the gravel packing operation and which further provides concentric flow paths through the cross-over assembly for transmitting fluid pressure to valving means and the interior of the packing element or elements to move them to set and sealed condition, whereby the outer diameter of the inflatable element in the sealed condition may preferably expand to at least twice the outer diameter of such element in the initial or run-in condition, for the sequential setting thereof while also transmitting a variation in the pressured fluid to actuate a valve for circulation of the gravel packing fluid exterior of the assembly and for permitting return of fluids through the assembly without the gravel. When plural packing elements are incorporated, the device includes valving components which permit the setting of the lower or sump packer prior to the setting of the gravel pack packer as well as the opening of the gravel packing sleeve valve and a valving component within the gravel packing screen for circulation. The device is mechanically manipulatable after the setting operation for various steps in gravel packing of a subterranean well through tubing introduced through production tubing disposed through a Christmas tree.

U.S. Pat. No. 4,378,845, issued Apr. 5, 1983, to Medlin et al., discloses a sand control method wherein high viscosity, high sand concentration, fracturing fluids are pumped through sets of vertically oriented perforations in borehole casings located in unconsolidated or loosely consolidated pay zones. Various techniques are utilized to insure that sand fills disposed on either side of the borehole casing cover and substantially overlap each borehole casing perforation set. Procedures are then followed to bring the well into production without washing out the sand fills in these areas, whereby the resulting perforation-sand fill configurations effectively control sand production from the treated zone.

U.S. Pat. No. 5,329,998, issued Jul. 19, 1994, to King et al., discloses a combination perforating/gravel pack assembly which includes a crossover circulation tool, a gravel pack screen, gravel pack accessories and a perforating gun which are interconnected by tubular flow conductors. External seals are located at longitudinally spaced locations along the upper end of the flow conductor string, above the gravel pack accessories and screens. External seals are also located at longitudinally spaced locations along the lower end of the flow conductor string, intermediate the screen and the perforating gun assembly. After crossover and reverse circulation are established, gravel slurry is pumped through an inner service string into the production annulus between the screen and the perforated casing. The slurry liquid is returned through a tell-tale screen upwardly through the washpipe and circulation tool, where it crosses over for return flow to the surface through a bypass annulus between the inner service string and the upper flow conductor seal assembly.

U.S. Pat. No. 5,845,712, issued Dec. 8, 1998, to C. F. Griffith, Jr., discloses apparatus and associated methods for performing operations within a subterranean well to overcome many disadvantages associated with perforating and fracturing and/or gravel packing by making a single trip of a work string into the well. In a preferred embodiment, a method of producing fluids from a formation intersected by the well includes the step of setting a packer having a relatively large seal bore formed therethrough in the well before running the work string into the well. After the formation is perforated, the work string is displaced to position a seal assembly on the work string in the seal bore, thereby displacing the perforating guns through the packer, positioning a screen opposite the perforated formation, and enabling performance of gravel packing operations thereafter.

U.S. Pat. No. 5,623,993, issued Apr. 29, 1997, to Van Buskirk et al., discloses a wellbore to be treated which is at least partially obstructed with a partition or obstruction member. A fluid slurry of an aggregate mixture of particulate matter is pumped into the wellbore adjacent the partition or obstruction member. The aggregate mixture of particulate material contains at least one component of particulate material, and each of the at least one particulate material components has an average discrete particle dimension different from that of the other particulate material components. Fluid pressure then is applied to the aggregate material and fluid is drained from the aggregate material through a fluid drainage passage in the partition or obstruction member. The fluid pressure and drainage of fluid from the aggregate mixture combined to compact the aggregate mixture into a substantially solid, load-bearing, force-transferring, substantially fluid-impermeable plug member, which seals a first wellbore region from fluid flow communication with a second wellbore region. The plug member is easily removed from the wellbore by directing a high-pressure fluid stream toward the plug member, thereby dissolving or disintegrating the particulate material of the plug member into a fluid slurry, which may be circulated out of or suctioned from the wellbore.

U.S. Pat. No. 5,954,133, issued Sep. 21, 1999, to C. M. Ross, discloses methods of completing wells utilizing wellbore equipment positioning apparatus to provide repositioning of sand control screens and perforating guns without requiring movement of a packer in the wellbore. In a preferred embodiment, a well completion method includes the steps of lowering a packer, positioning device, sand control screen, and perforating gun into a well, perforating a zone intersected by the wellbore, expanding the positioning device, and positioning the sand control screen opposite the perforated zone.

U.S. Pat. No. 6,059,033, issued May 9, 2000, to Ross et al., discloses apparatus for completing a subterranean well and associated methods to provide economical and efficient well completions. In one described embodiment, a well completion apparatus includes a packer which is settable by application of a compressive axial force thereto. The packer sealingly engages a wellbore of the well when set therein, but does not anchor to the wellbore. The apparatus further includes a screen and an attachment device. The attachment device permits the apparatus to be attached to another packer previously set and anchored within the wellbore.

U.S. Pat. No. 6,138,755, issued Oct. 31, 2000, to R. Swartwout, discloses a method for enhancing the compatibility of a zinc-brine completion fluid with a fracturing fluid. Test samples of selected completion fluids are combined with test samples of selected fracturing fluids to form an admixture. The parameters of incompatibility between the completion fluid and the fracturing fluid are analyzed and identified. The parameters or indicia of incompatibility identified can be precipitation, emulsification and/or an increase in viscosity. The zinc brine completion fluid is then blended with additives to remove these parameters of incompatibility. The additives can be selected from a group comprising hydrochloric acid, hydrobromic acid, acetate salts, citrate salts, and surfactants. At the well site, the altered zinc brine completion fluid is pumped in to displace drilling fluids in the wellbore before pumping in fracturing fluid. Additional altered brine completion can follow the fracturing fluid into the wellbore. Commingling of the altered zinc brine completion fluid with fracturing fluid in the wellbore or the formation can occur without substantial damage to the formation.

U.S. Pat. No. 6,206,100, issued Mar. 27, 2001, to George et al., discloses a system and method for perforating and gravel packing a wellbore casing in a single trip into the wellbore comprising a gravel packer assembly having a production screen and at least one packer. A perforating apparatus is connected to the gravel packer assembly, wherein the perforating apparatus is detachable from the gravel packer assembly after the system is placed in the wellbore and before a detonation of the perforating apparatus. A tool is disclosed having at least one casing engaging slip segment, wherein the tool is matable with the perforating apparatus and is settable in the wellbore casing.

U.S. Pat. No. 6,220,353, issued Apr. 24, 2001, to Foster et al., discloses a full bore set down tool assembly that provides a housing attached to a packer in a wellbore aligned with the production zone. A service tool of the tool assembly is attached to a tubing string extending to the surface and is adapted for selective, removable attachment to and positioning within the housing. The tool assembly defines a downstream flow path and a return flow path when the service tool is attached to the housing. A ball valve that is selectively shiftable from the surface opens and closes the return flow path to define a circulate position and a squeeze position. The housing, service tool, and ball valve also define a reverse position. The tool assembly facilitates gravel packing of the annulus between the wellbore casing and the service string including the tool assembly.

U.S. Pat. No. 6,230,802, issued May 15, 2001, to M. Duhon, discloses an apparatus for use in gravel packing a well which includes a tool body adapted to be lowered into the well, a screen coupled to the tool body, and a resilient member coupled to the screen. The apparatus is placed at a selected position in the well, and sand control media is disposed between the screen and the well while the resilient member is periodically excited to vibrate the screen.

U.S. Pat. No. 6,241,013, issued Jun. 5, 2001, to W. J. Martin, discloses a one-trip squeeze pack system which has a unique service seal unit design using concentric tubing, with the inner tubing an extension of the traditional wash pipe and is later used as the production tubing. The inner tubing contains a ported sub which can be isolated in various positions within the outer tubing by way of seals located above and below the ported sub. This seal unit is raised and lowered on the production string and isolated at various positions in order to accomplish setting the packer, running a packing job, reversing out packing fluid, and receiving production fluids.

U.S. Pat. No. 5,505,260, issued Apr. 9, 1996, to Anderson et al., discloses a single trip system for placing perforating apparatus and sand control equipment in a wellbore. This system includes a casing string equipped with extendible pistons and a pumpable activator plug for extending the pistons. Additionally, this system utilizes a single gravel-pack and completion tool string. Further, this system includes a means for opening the extendible pistons to fluid flow.

U.S. Pat. No. 5,492,178, issued Feb. 20, 1996, to Nguyen et al., discloses fracturing, frac-pack, and gravel packing procedures which utilize a treating composition comprising a carrier fluid and a particulate blend. The particulate blend consists essentially of a large particulate material and a small particulate material. The large particulate material consists essentially of particles smaller than about 4 mesh but not smaller than about 40 mesh. The small particulate material consists essentially of particles smaller than about 16 mesh but not smaller than about 100 mesh. The small particulate material is present in the particulate blend in an amount in the range of from about 5% to about 60% by weight based on the amount of the large particulate material present in the particulate blend. A prepacked screening device including a large particulate/small particulate blend of the type just described is also provided.

U.S. Pat. No. 6,176,307, issued Jan. 23, 2001, to Danos et al., discloses that after installing an inventive tool attached to production tubing in a well, the well can be gravel packed without the use of a well intervention unit. The tool isolates a productive interval and diverts tubing-conveyed sand slurry towards an annular location by means of a port and an openable passageway restrictor. The entraining fluid component of the diverted sand slurry in the annular location is allowed to re-enter the production tubing through a first screen while the separated sand drops to the annular location to be packed in an axial direction. Rupture of a plug then allows the separated sand to be packed in an axial direction.

The above cited prior art does not disclose how to perform a Frac Pack in a high pressure production zone utilizing low weight completion fluids that do not in themselves provide a sufficient downhole hydrostatic pressure to control the production zone while also reducing or eliminating rig time for completion operations to thereby improve well performance and lowers costs. Consequently, those skilled in the art will appreciate the present invention that addresses these and other problems.

SUMMARY OF THE INVENTION

The present invention provides methods of completing oil and gas wells in subterranean unconsolidated zones with high completion efficiency, and reduced costs, utilizing readily available equipment. The improved methods eliminate the need for high-density, and high cost, completion fluids. The improved methods reduce drilling rig costs and other costs. The improved methods lower the various costs of deploying a dual-screen assembly in the well. In wells without a high deviation, or hole angle, a preferred method of the present invention also eliminates the cost of coiled tubing equipment. Many wells have multiple producing zones, and a preferred embodiment of this invention allows for the re-completion of zones in the wellbore to performed, in many cases, completely without the use of a workover rig.

In a new well, casing is run into the well and cemented in place. With the rig on location, a cast iron bridge plug may be run into the well with electric line, or on drill pipe, and set a depth below the lowest-most zone to be completed. The drilling fluid used to drill the well is then displaced out of the wellbore with a low-density well completion fluid such as potassium chloride. A production packer is run in the well on electric line or drill pipe and set at a depth approximately 100 feet above the uppermost commercial zone in the wellbore. Production tubing of various size is run into the well and the seal assembly near the bottom of this production tubing is set into the bore of the production packer. The wellhead tree is installed, and two sub-surface safety valves may preferably be placed in the production tubing string at a specified depth. In a preferred embodiment, the rig can then be moved off the well, and the completion operations initiated according to the present invention. In an offshore environment, a lift boat can be used for the remainder of the well completion. In some cases offshore, the well to be completed is tied back into a producing platform. If the platform has adequate deck space, and weight requirements, the initial and subsequent completions can be performed on the production platform.

Normally, a wellhead isolation tool is installed to eliminate pressure and erosion from the wellhead tree during the Frac Pack operation. An electric line logging and perforating unit is rigged up on the lift boat, or the platform, on an offshore well. Correlation and cased hole production logs are run, and then the zone is perforated through-tubing with a perforating device run on the electric line. The perforating device is detonated after a predetermined amount of pressure is placed on the well to compensate for the differential between the hydrostatic pressure of the well completion fluid such potassium chloride brine and the bottom hole pressure of the zone. This pressure is maintained on the well at the time of perforating gun detonation to prevent the zone from producing any formation sand into the wellbore. By manipulating the sub-surface safety valves with respect to the position of the perforating gun in the wellbore, pressure is maintained on the well as the wireline guns are extracted such that the bottom hole pressure adjacent zone is slightly overbalanced. In a similar manner of operating the sub-surface safety valves, sufficient bottom hole pressure is maintained as the dual-screen assembly is made up and run into the well. This assembly is run into the well and placed on top of the bridge plug by use of the electric line, braided line, or coiled tubing. A disconnect device is run at the top of the dual-screen assembly, and the assembly is separated from the deployment line, or coiled tubing.

With a wellhead isolation device made up on the top flange of the wellhead tree, equipment to perform the Frac Pack/gravel pack operation is mobilized to the well. In the case of a Frac Pack, the required fluids, additives, and proppants are pumped down the production tubing and into the zone, traveling through the casing/dual-screen annulus into the perforations. The displacement of the Frac Pack is preplanned to leave a few barrels of frac fluid and proppant above the top of the vent screen, which is at the upper part of the dual-screen assembly. As soon as the Frac Pack is completed, the zone pressure is utilized wash out or carry the excess proppant/slurry above the top of the vent screen out of the well by back flowing the well. In the case of some wells, particularly in the case of low bottom-hole pressure zones and highly deviated wellbores, coiled tubing may be required to wash out the excess proppant. The well, or zone, can then be put on production.

In the case where a well has a number of potential zones, the method of the present invention is utilized first on the lowest zone in the wellbore. After the lowest zone is depleted, or no longer produces oil and/or gas at a commercial rate, equipment is mobilized on a lift-boat, or to the production platform, to perform a re-completion on the next highest zone in the well. A through-tubing bridge plug is run on electric line, and set at a pre-determined depth. Ten to fifteen feet of cement is dump bailed on top of the bridge plug, the plug tested, and the zone is perforated with a relatively low density completion fluid in the wellbore, such as potassium chloride, with additional pressure applied to the well as discussed above such that the hydrostatic pressure adjacent the new production zone is slightly overbalanced with respect to the formation pressure. Other steps in the preferred method for the remainder of the completion may be identical to that described hereinbefore for the lowest zone of the new well. As each zone is depleted, the same or similar procedure is used for the re-completions.

Accordingly, the present invention provides a method of completing a well with one or more potential production zones which may comprise one or more steps such as, for instance, filling the wellbore with a completion fluid having a density such that a hydrostatic pressure of the completion fluid created within the wellbore adjacent the first production zone is less than the first production zone formation pressure, installing a production packer preferably above the one or more production zones, installing production tubing within the well with a rig such that a bottom end of the production tubing is preferably positioned above the one or more production zones, providing the production tubing with at least one subsurface valve positioned therein, moving the rig off the well, running a perforating gun into the well, applying an applied pressure to the wellbore such that a total pressure of the hydrostatic pressure and the applied pressure in the wellbore adjacent the first production zone is greater than the first production zone formation pressure, perforating the wellbore adjacent the first production zone, pulling the perforating gun above the at least one subsurface valve, closing the at least one subsurface valve to maintain the total pressure in the wellbore adjacent the first production zone, running a screen assembly into the wellbore above the valve while the valve remains closed, opening the at least one subsurface valve, positioning the screen assembly in the wellbore adjacent the first production zone, and pumping fracturing slurry around the screen assembly and into the first production zone with a sufficient pressure to fracture the first production zone.

Other steps may further comprise removing excess components of the fracturing slurry from the wellbore without use of coiled tubing such as by utilizing the first production zone formation pressure to create fluid flow within the wellbore for removing excess components of the fracturing slurry from the wellbore.

When the first production zone is no longer economical to produce, the method may further comprise completing upper production zones without the need for bringing a workover rig back onto the well. This embodiment of the invention may comprise steps such as plugging off the first production zone at a well depth below the second production zone and above an uppermost perforation of the first production zone, filling the well with a second completion fluid which may have a density such that a hydrostatic pressure of the second completion fluid created within the wellbore adjacent the second production zone is less than the second production zone formation pressure, perforating the second production zone without use of the workover rig, installing a second screen assembly adjacent the second production zone without use of the workover rig, and/or pumping fracturing slurry around the second screen assembly and into the second production zone with a sufficient pressure to fracture the second production zone.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout several views of the drawings and wherein.

DESCRIPTION OF THE PREFERRED EMBODIMENTS

The present invention shows methods for greatly reducing the cost of completing wells. The cost savings produced by the present method are especially significant for offshore wells, which typically have high daily rig costs. By utilizing the method of the present invention, drilling and workover rig time is greatly reduced and may be completely eliminated for completions of alternative production zones. Moreover, the present invention eliminates the need for high-density well completion fluids such as zinc bromide. Zinc bromide brine presently costs approximately $600 per barrel and has been found to damage formation. Thus, not only does the method of the present invention save significant costs by avoiding the need for zinc bromide fluid, but also results in a more productive well.

Figure 1:
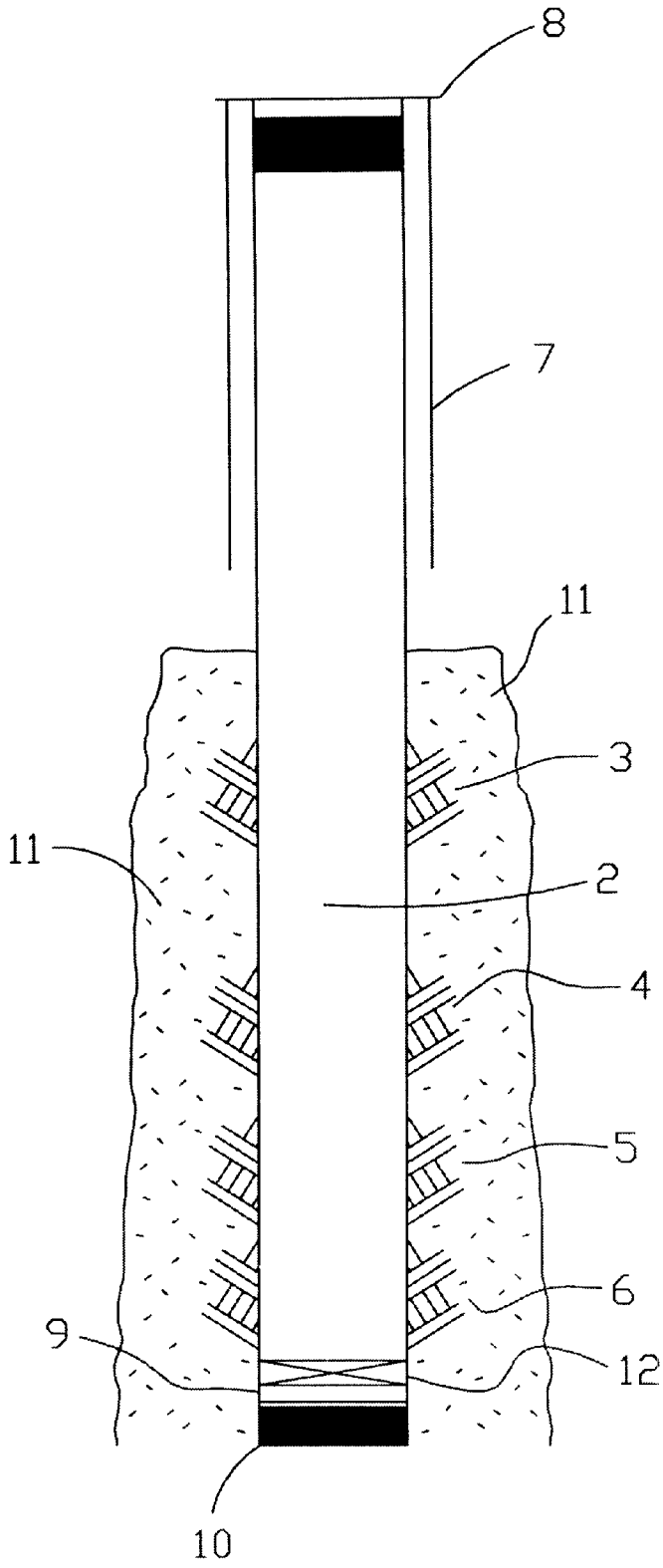
FIG. 1 is an elevational view, in cross-section, of a typical wellbore schematic before the production packer, tubing, and dual-screen assembly have been placed in the well but after the bridge plug has been positioned in place below the lowermost production zone.

FIG. 1 shows a cross-sectional view of wellbore 2 drilled through a series of formations and zones 3–6 below surface on land or offshore 8. The zone of primary interest 6 may be oil and/or gas productive. Zones 3–5 are described as "Alternate Zones" for future re-completions. Surface casing 7 has been set. Production casing 9 has been run a total depth 10 and cement 11 has been injected into the annulus between the formation and production casing 9 to isolate the various zones as is common practice. Bridge plug 12 has been placed in casing 9 at a depth below primary zone 6 by some suitable means such as on electric wireline, or on drill pipe.

Figure 2:
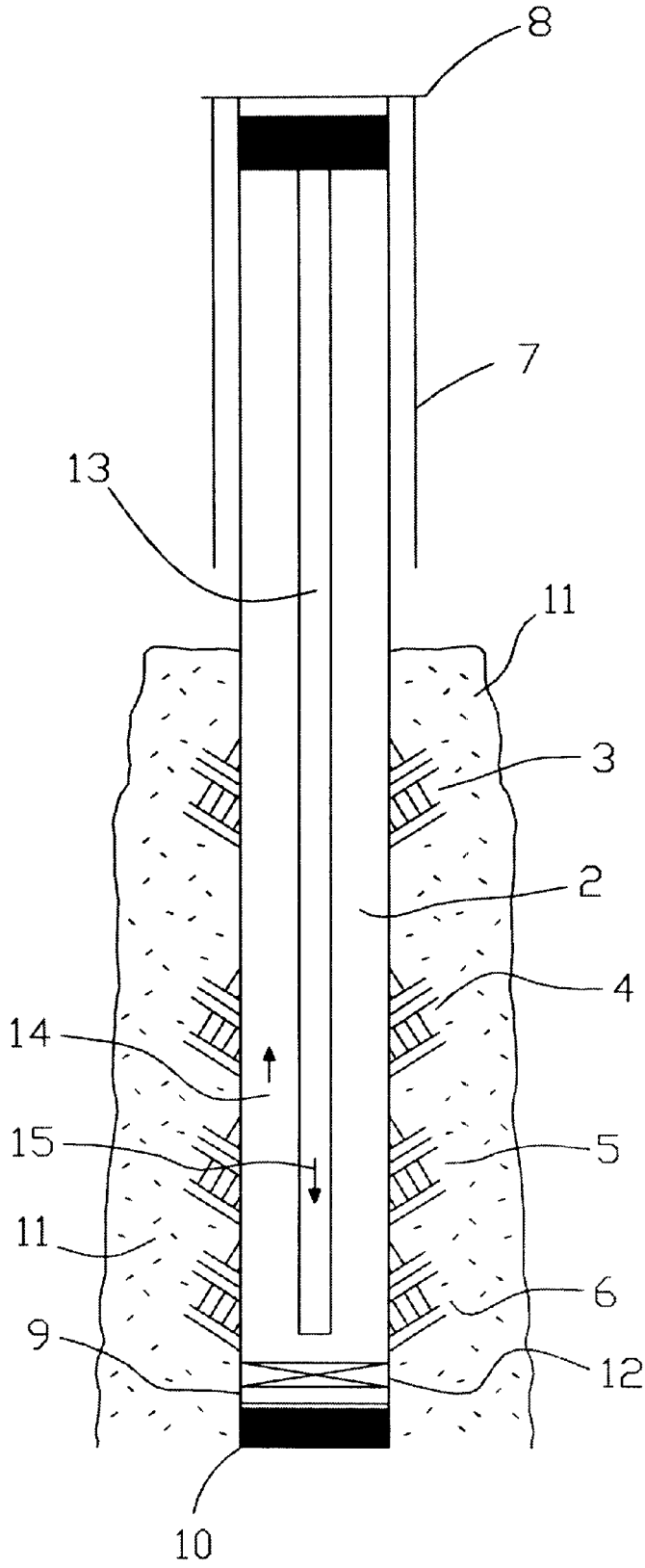
FIG. 2 is an elevational view, in cross-section, showing the wellbore with drill pipe run to the bottom of the well, and the drilling fluid/mud being displaced out of the wellbore with a low density well completion fluid such as potassium chloride brine.

FIG. 2 shows a cross-sectional view of the wellbore with drill pipe 13 run to the top of the bridge plug 12. Drilling fluid/mud 14 may now be displaced out of the casing 9 with a suitable completion fluid such as potassium chloride brine 15 as discussed in more detail hereinafter. After extracting the drill pipe 13 from the wellbore, various logs may be run on electric line to evaluate the quality of the cement 11 and/or to determine what type hydrocarbons are present in zones 3–7.

Figure 3:
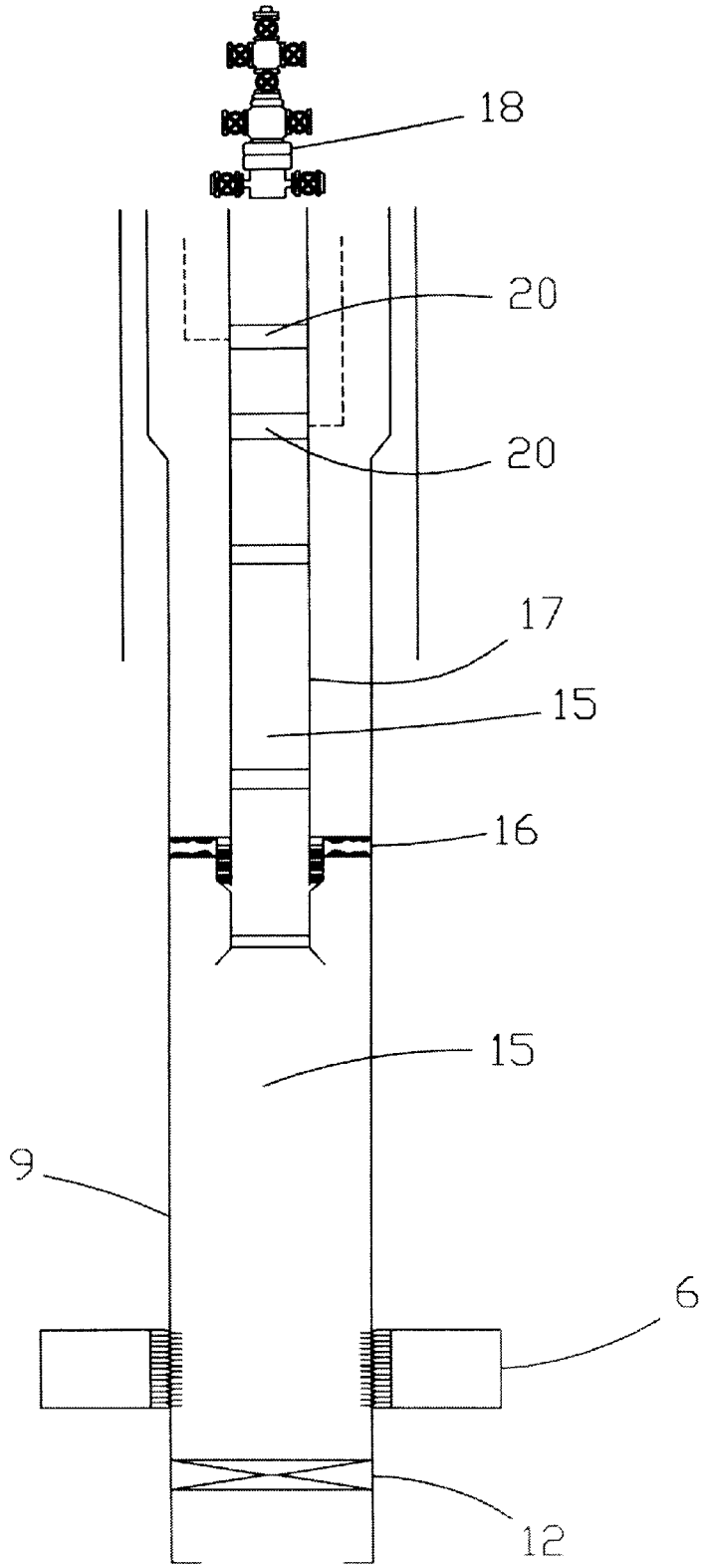
FIG. 3 is an elevational view, in cross-section, showing a well with packer, tubing, wellhead tree, and a pair of Subsurface Safety Valves placed in the wellbore.

FIG. 3 shows the well configuration after production packer 16 has been run into casing 9 and set at a predetermined depth. Production tubing 17 is then run into the well and placed into the bore of the production packer 16. Wellhead tree 18, frequently referred to as a Christmas Tree, is installed on the top of casing 9 at the surface 8. In this example, two subsurface safety valves 20 are placed in production tubing string 17 to act as pressure barriers between the zones and the surface as discussed hereinafter. The rig is then removed from the well location, and the completion procedure starts. Production tubing 17 and casing 9 are now filled with a suitable completion fluid, as discussed below, such as potassium chloride brine 15 which will typically have a weight less than about nine pounds per gallon and may typically range from about 8.5 pounds/gal to about 9 pounds/gal. However, one purpose of the invention is to avoid use of high-density brines that may typically have densities from about 14 pounds/gal to about 20 pounds/gal. Thus, the present invention may be used with lower density brines having weights typically less than 11 pounds/gal and generally less than 14 pounds/gal.

Figure 4:
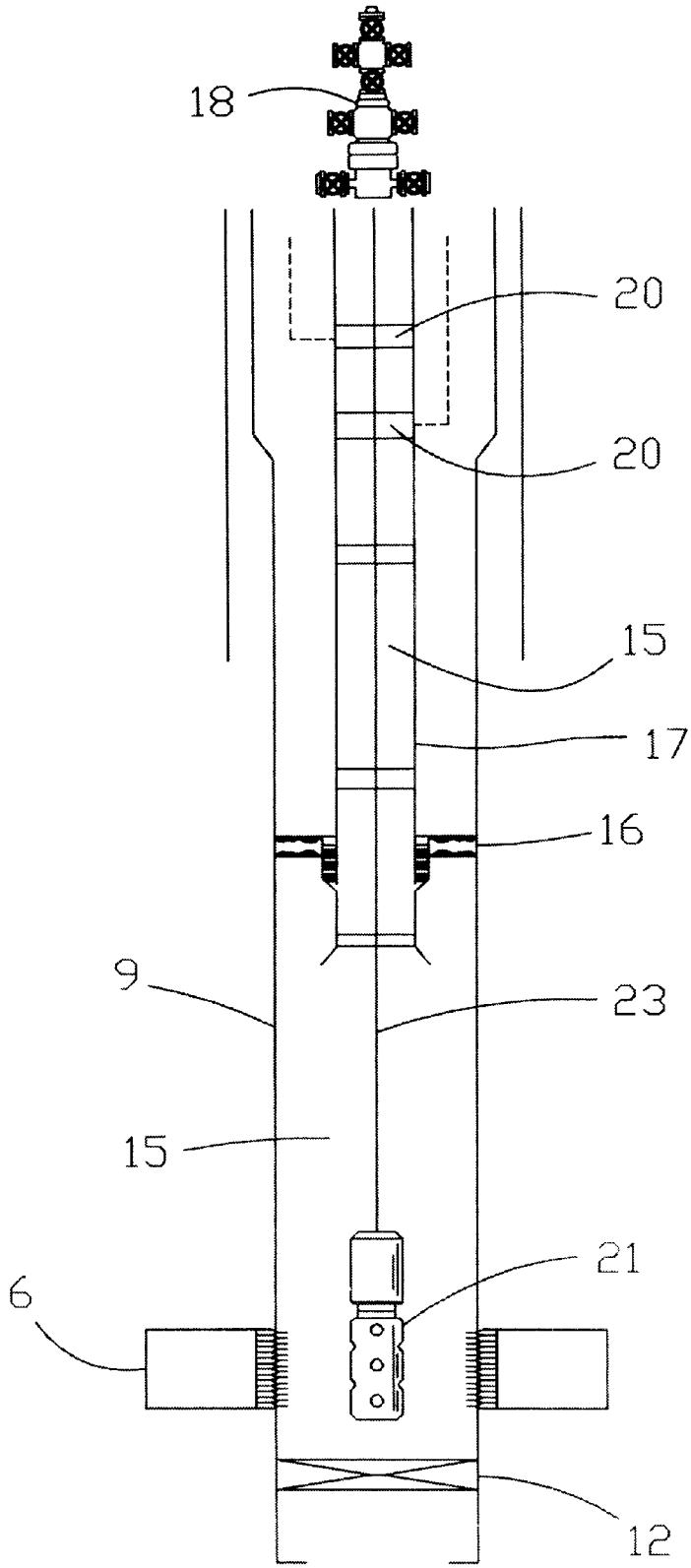
FIG. 4 is an elevational view, in cross-section, showing the wireline through-tubing perforating procedure.

FIG. 4 illustrates the wellbore/casing being perforated through tubing with a wireline gun 21, run on an electric line 23. Wireline may include braided lines capable of transmitting electricity, cables with an insulated wire therein, and the like. Sealing means (not shown) are provided for electric line 23 such that electric line 23 can be moved into and out of the well without loss of pressure. Such suitable sealing means are well known and may comprise a grease injector or other means. A calculated amount of pressure is placed on production tubing 17 so that, together with the hydrostatic pressure of the column of the well completion fluid, the total bottom hole pressure will equal, or slightly surpass, the anticipated bottom hole formation pressure of zone 6. This preferred embodiment of the invention therefore eliminates the use of high-density completion brines, which have very high costs and may cause damage to the formation. An example calculation to determine this applied surface pressure is as follows:

Depth Zone 6—10,000 ft.

Bottom Hole Pressure Zone 6—6,000 psi

Weight lbs/gal potassium chloride—8.6

$$\begin{aligned}\text{Required Applied Surface Pressure(psi)} &= \text{BHP} - \text{Hydrostatic Pressure KCl}\\ &= 6{,}000 - (8.6 \times .051 \times 10{,}000)\\ &= 6{,}000 - 4{,}386 = 1.614 \text{ psi}\end{aligned}$$

After zone 6 has been perforated, the wireline gun 21 is retracted from the wellbore by pulling wireline gun 21 above at least one of subsurface valves 20. Once the wireline gun is above at least one of subsurface valves 20, then the valve(s) can be closed to thereby maintain the total bottom hole pressure discussed above. It will be noted that because the calculated pressure is applied prior to perforating and is maintained on the well to slightly overbalance the formation pressure, the formation does not flow any formation sand into the wellbore that might restrict fluid flow. Thus, subsurface safety valves 20 are therefore used to maintain the pressure on the zone 6. Once wireline gun 20 is pulled above valves 20, then valves 20 are closed and the pressure at the surface/wellhead tree 18 above valves 20 may be bled off to 0 psi. Wireline gun 21 can then be safely removed from the well without affecting the total bottom hole pressure.

Figure 5:
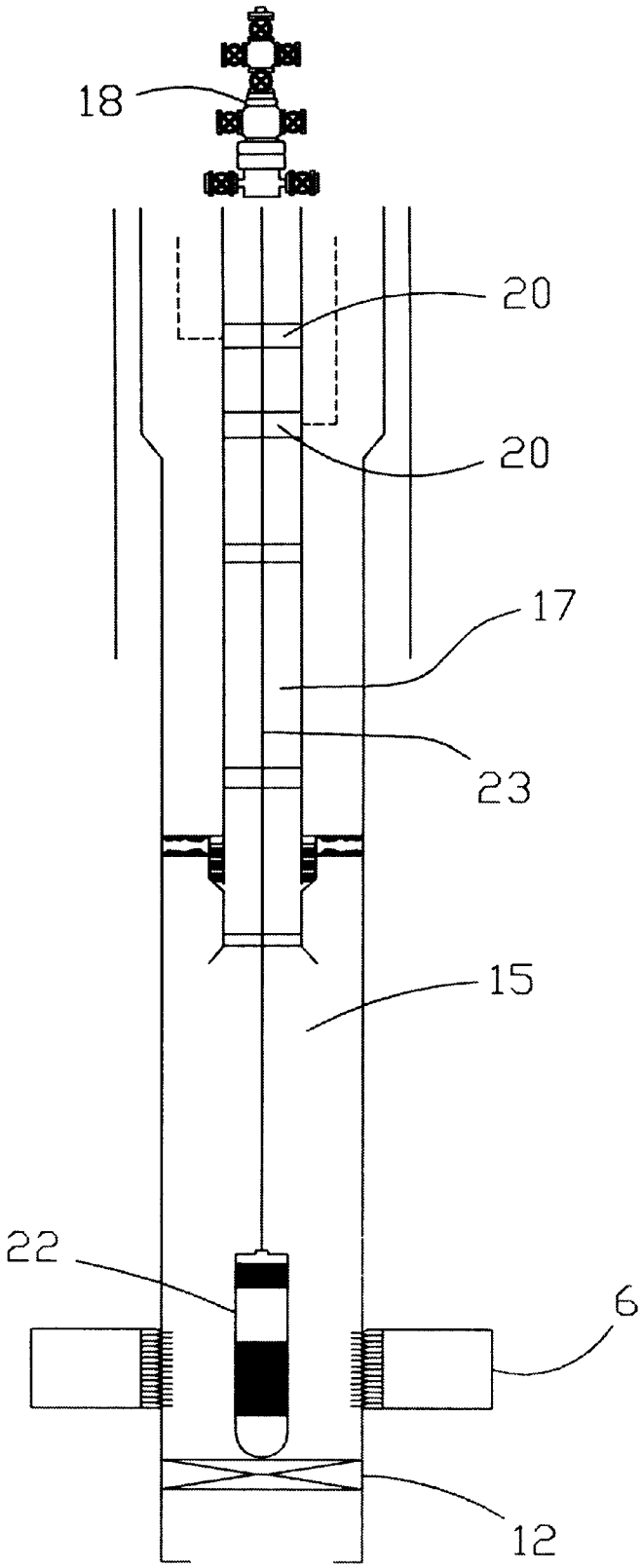
FIG. 5 is an elevational view, in cross-section, showing the deployment of the dual-screen assembly at the top of the bridge plug.

FIG. 5 shows the deployment of the dual-screen assembly 22, which can be placed in the wellbore on top of the bridge plug 12 by electric line 23, braided line, or coiled tubing. A dual-screen assembly as used herein comprises a tubular assembly having two screens separated by a blank section of tubing. The blank section is spaced by a desired amount such that after frac-packing hydrocarbon flow will occur through the dual screen assembly rather than the frac-packing around the dual-screen assembly discussed subsequently. This necessary amount of blank section can be determined and flow is prevented in accord with Darcey's rule. A dual-screen assembly is also known as a vent screen assembly. Dual-screen assembly 22 can be inserted above subsurface safety valves while the pressure in the production tubing is still 0 psi having been bled off as discussed above. After the dual-screen assembly 22 has passed through the wellhead tree 18, and the sealing means for electric line 23, such as a grease head, is activated to permit movement of the wireline while maintaining a pressure tight seal, then subsurface safety valves 20 are opened to allow the assembly to be lowered in the wellbore and deployed to the top of bridge plug 12. A disconnect device is attached to the top of dual-screen assembly 22 for all three methods of deployment. In the case where electric line 23 is used to run the dual-screen assembly 22 in the wellbore, a small explosive charge may be fired by passing current down electric line 23. Electric line 23 is separated from the dual-screen assembly, leaving the dual-screen assembly 22 in the wellbore on top of the bridge plug 12. In the case where coiled tubing is used to deploy the dual-screen assembly 22, a small diameter metal ball may be pumped down the coiled tubing until it has reached a ball seat in the disconnect device. With additional pressure applied, the coiled tubing separates from the dual-screen assembly 22, leaving the assembly on top of the bridge plug 12. The electric line 23, coiled tubing, or braided line is then extracted from the wellbore and from the wellhead tree 18 by utilizing subsurface safety valves 20 as discussed above.

Figure 6:
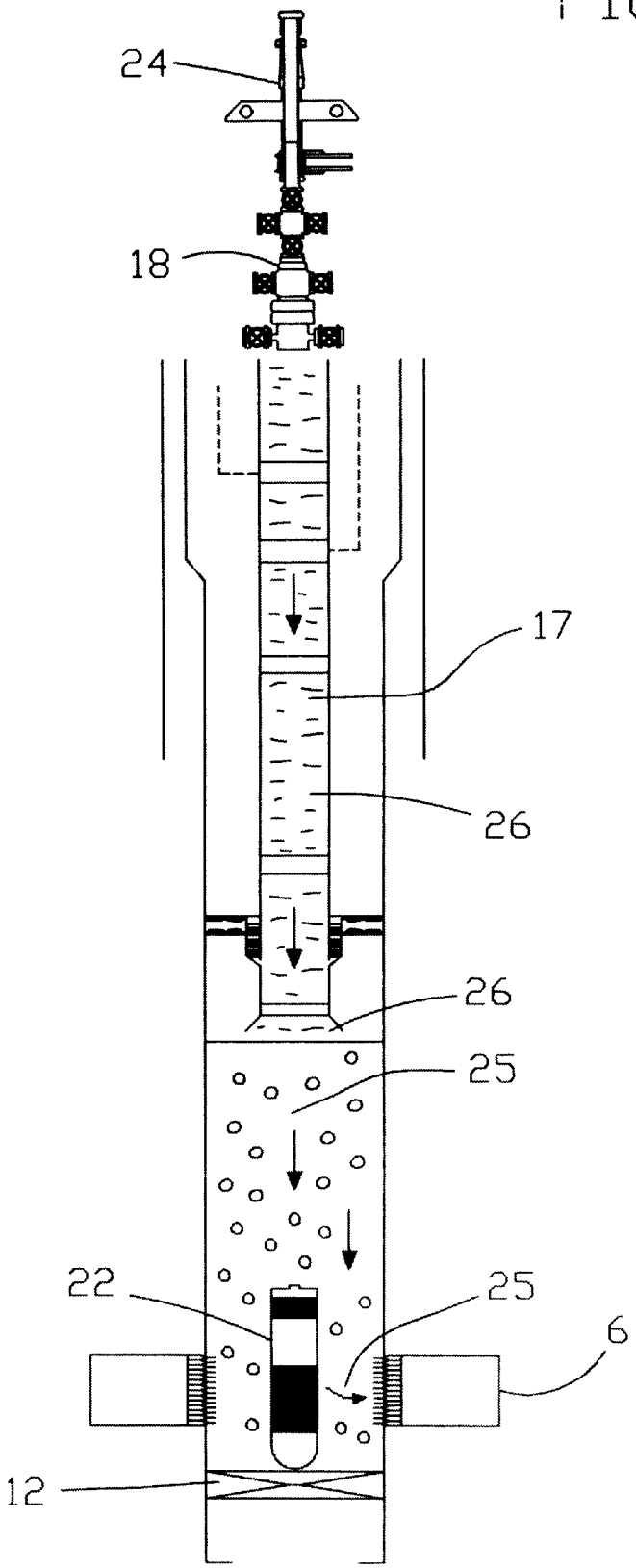
FIG. 6 is an elevational view, in cross-section, showing the wellhead isolation tool attached to the top of the wellhead tree after which the selected payzone is then Frac Packed utilizing fracturing fluid slurry pumped into the casing, and the annulus between the dual-screen assembly and the casing thereby creating an interface of the Frac Pack slurry and the displacing fluid at the end of the Frac Pack operation.

FIG. 6 shows a wellhead isolation tool 24 that has been installed on top of the wellhead tree 18 to isolate the wellhead tree 18 from the high pressures during the Frac Pack operation. Wellhead isolation tool 24 also protects wellhead tree 18 from possible metal erosion caused by the proppant-laden Frac Pack slurry 25 pumped down tubing 17 and into the zone 6. High pressure pumping and blending equipment are mobilized at the well site, rigged up to wellhead isolation tool 24, and the Frac Pack procedure is performed. By the use of information obtained during the calibration phase of the Frac Pack operation, proppant slurry 25 is displaced to within a few barrels of the top of dual-screen assembly 22 by a low density displacing fluid 26. The wellhead isolation tool 24 is removed from the wellhead tree 18, and the high pressure pumping and blending equipment is rigged down.

Figure 7:
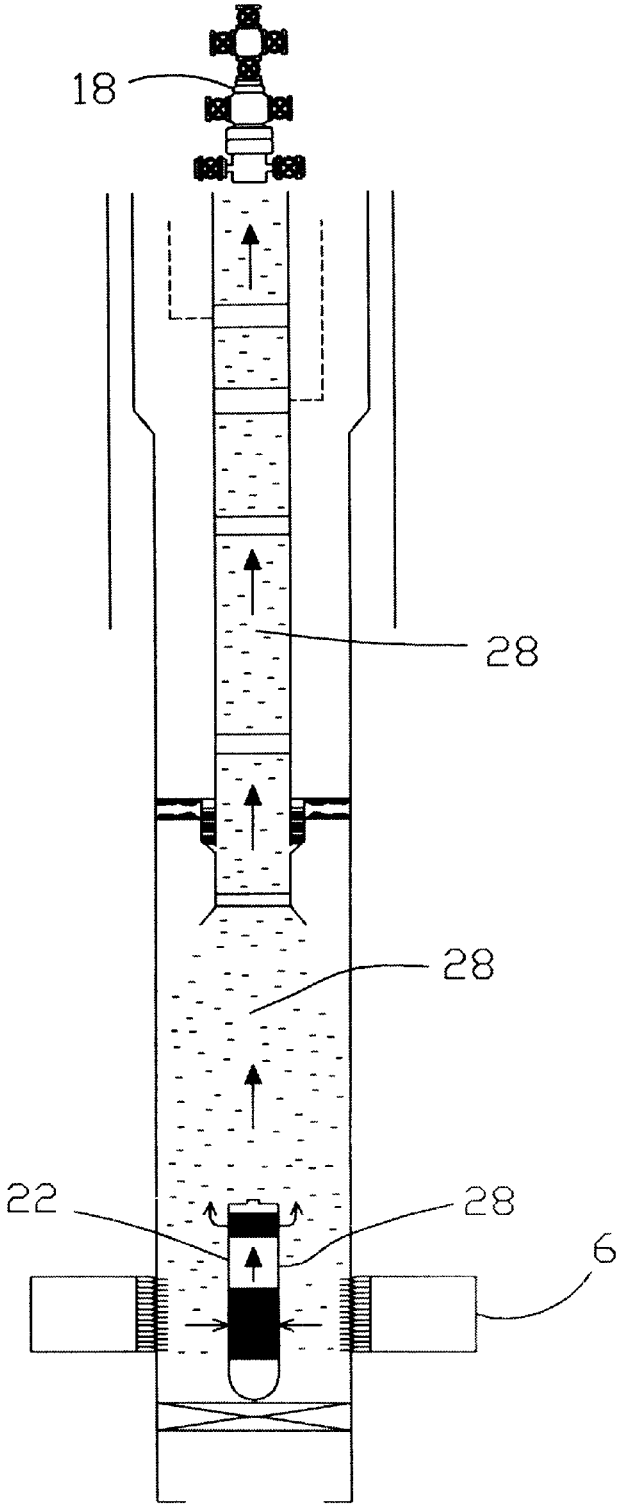
FIG. 7 is an elevational view, in cross-section, showing the flow path of oil and/or gas after the zone and the dual-screen annulus have been frac packed, and the zone is preferably flowed back carrying the excess slurry/proppant off the vent screen.

FIG. 7 shows the flow path 27 of the oil and/or gas 28 which is produced up the wellbore after the completion procedure has been completed. By utilizing the formation pressure of production zone 6 in accord with the present invention, it may be possible, depending on well conditions as discussed above, to remove or wash excess proppant from the Frac Pack procedure above dual-screen 22 without the need for coiled tubing to perform this function. Thus, in one preferred embodiment of the present invention, the costs of requiring a coiled tubing unit for completion purposes are also eliminated.

Figure 8:
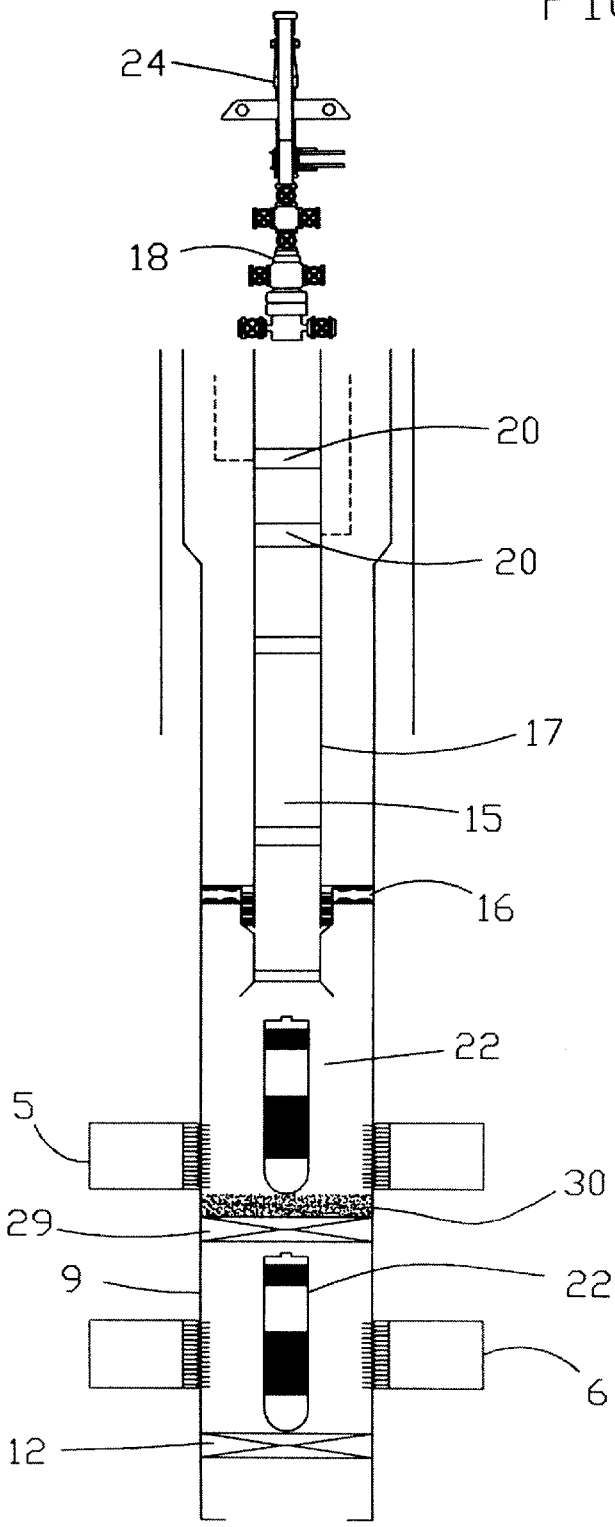
FIG. 8 is an elevational view, in cross-section, showing the wellbore after the lower zone/or zones have been effectively depleted from commercial production of oil, or gas whereby the lower zone/zones are plugged off from the next zone with a through-tubing bridge plug and cement on top, the new zone perforated, a new dual-screen assembly deployed, and the new zone is Frac Packed.

FIG. 8 shows a wellbore that has had lower zone 6 completed using this invention, and subsequently lower zone 6 no longer produces oil or gas at commercial rates. A preferred embodiment of the present invention saves future well completion costs for the well by completely eliminating the need to move a rig such as a workover rig back onto the well. On an offshore well, a lift-boat is then mobilized to the well, if it is a single caisson type, with electric line equipment, a new dual-screen assembly 22, through-tubing bridge 29, cement and a dump bailer, wireline perforating guns, and wellhead isolation tool 24. If the offshore well is on a production platform, this equipment is brought out and set up on the platform deck. The well is filled with a completion fluid such as potassium chloride completion brine, and the electric line deploys through-tubing bridge plug 29 into the wellbore and sets the plug at a depth approximately 20 feet below the next zone to be completed. A dump bailer is then run on electric line, and 10–15 feet of cement are placed on top of the through-tubing bridge plug 30. The wireline perforating guns are then run into the wellbore on electric line, and next higher zone 5 is perforated. The new dual-screen assembly 22 is run in the wellbore, and placed on top of the through-tubing/cement plug 30. The Frac Pack operation, with the wellhead isolation tool 24 installed, may be performed identically to the Frac Pack operation discussed hereinbefore in connection with lower zone 6. The zone 5 may be flowed back the same as was zone 6. Subsequent zones, such as 3 and 4 in this example may be completed at a later time in an identical manner as discussed hereinbefore with respect to zones 5 and 6. In this embodiment of the invention, production packer 16 is set high enough in the casing 9 to allow for this method of multizone completions to be utilized. Thus, the above-discussed embodiment of the present invention saves oilfield operators a large amount of money on future well completions.

Figure 9:
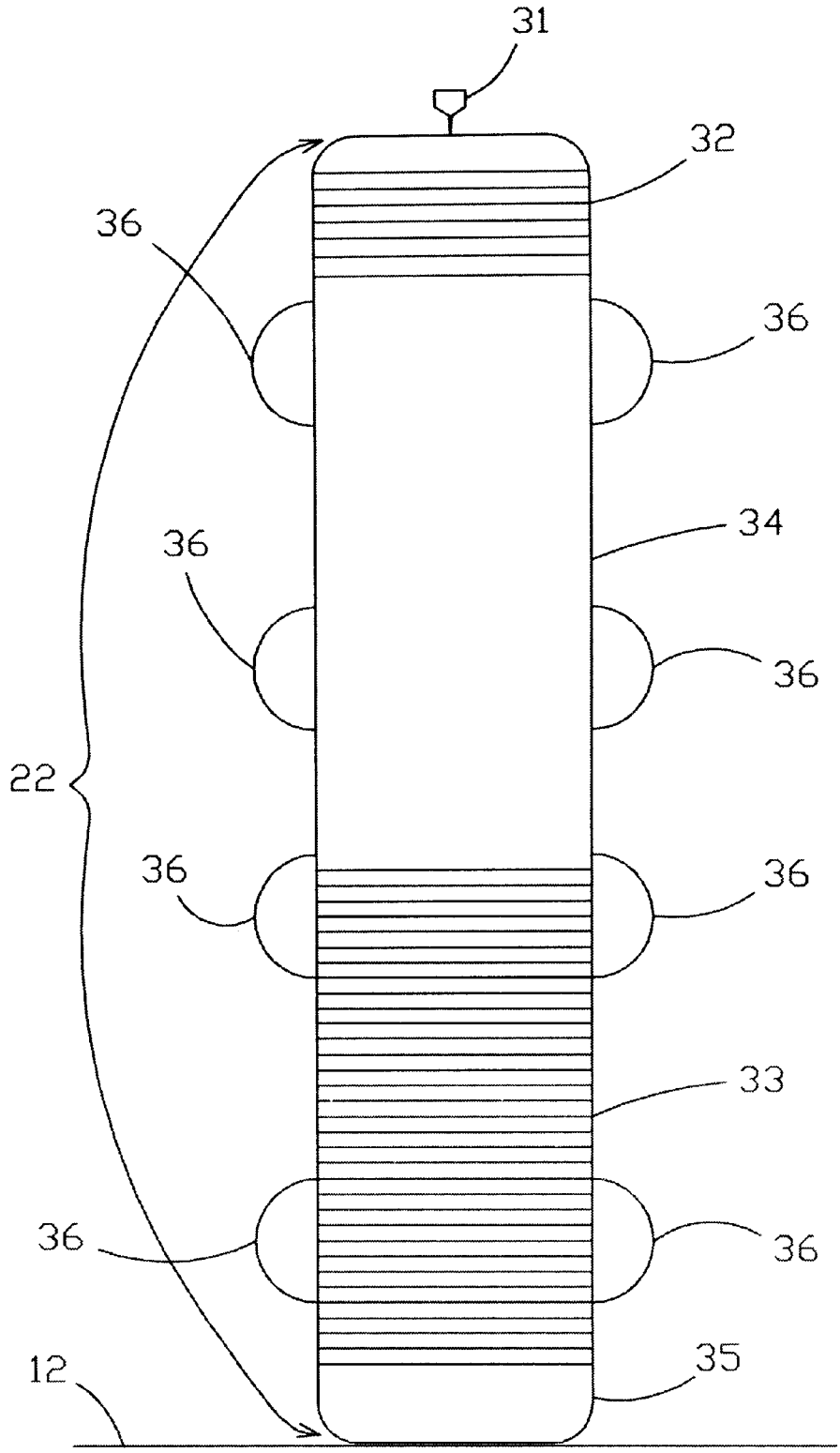
FIG. 9 is an elevational view, in cross-section, showing components of a dual-screen assembly for use in accord with the present invention.

FIG. 9 shows one possible embodiment of a more detailed drawing of a dual-screen assembly 22 which may be utilized in accord with the present invention. Those of skill in the art know other details and variations of screen assemblies. Screen assembly 22 is a closed cylinder that may be placed in a wellbore through the wellhead tree and tubing to the top of bridge plug 12. At the top of the assembly is a device called disconnect 31. This allows the assembly to be left in place in the wellbore on top of bridge plug 12, after being deployed by electric line 23. Vent screen portion 32 of the screen assembly is normally 5–10 feet in length, and may preferably be exactly the same basic type of screen material as production screen 33. Below vent screen 32 is a section of blank tube 34. The length of blank tube 34 is appropriately selected to allow for the annular pack of proppant external to blank tube 34 and dual-screen assembly 22 to be sufficient to prevent flow of oil or gas up the annulus between blank tube 34 and the casing. The length is a calculated based on Darcey's Law of flow through a porous media. The section below blank tube 34 is called production screen 33. The length of production screen 33 is based on the height of the proposed perforated interval. For instance, production screen 33 may be designed to be 10 feet longer length than the height of the perforated interval and to be positioned such that production screen 33 extends 5 feet below the lowest perforation, and 5 feet above the uppermost perforation. At the bottom of the dual-screen assembly 22, is a bull plug 35, which allows the assembly to be place on the bridge plug without the lowest section being screen. The dual-screen assembly 22 has a series of bow-type centralizers 36, attached at predetermined positions. These bow-type centralizers 36 expand when the device goes below the end of the tubing, and helps keep the dual-screen assembly 22 centralized in the casing. This allows the annular pack of proppant in the production screen 33 and the blank 34 to cause the flow of oil and gas to pass into the production screen 33, up the inside of the device, and flow out of the vent screen 32. The flow of oil and gas then enters the production tubing to the surface of the well. The outside diameter of the dual-screen assembly 22 is determined by the inside diameter of the production tubing.

Figure 10:
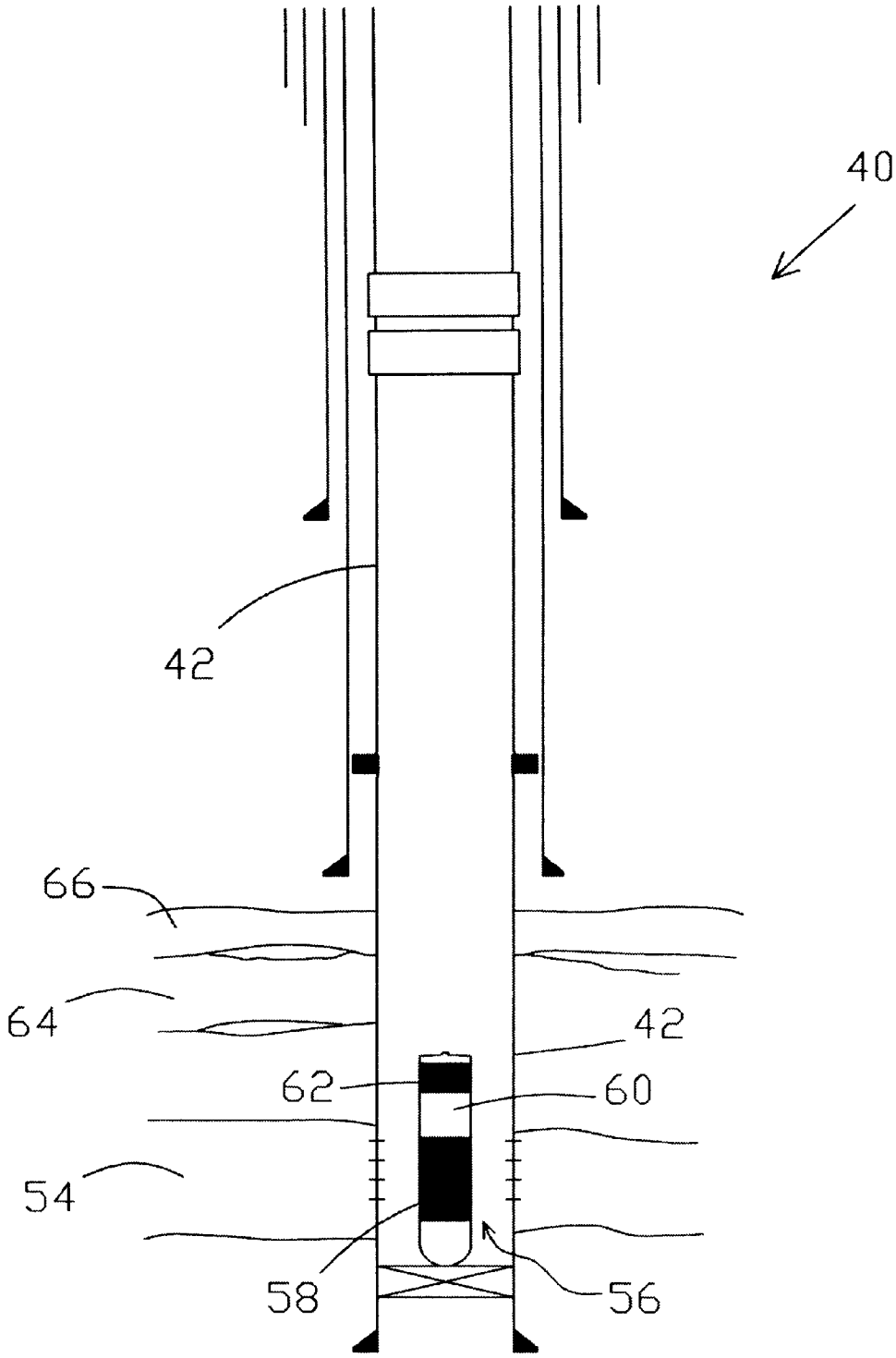
FIG. 10 is an elevational view, in cross-section, showing components of a monobore/tubingless completion and utilized in accord with the present inventon.

The present invention can also be utilized with monobore or "tubingless" completions. FIG. 10 shows a typical feature of monobore/tubingless completion 40 wherein the ID of completion string 42 may be substantially the same size from top to bottom. Thus, for monobore or tubingless completions, it is not necessary to have a production tubing string mounted in a production packer within the production casing string such as, for example, production string 17 mounted within production packer 16 within casing string 9 as shown in FIG. 8. In fact, as can be seen from FIG. 10, there is no production packer. Moreover, the same production string 42 is utilized both for hydrocarbon flow and for casing the wellbore.

Figure 11:
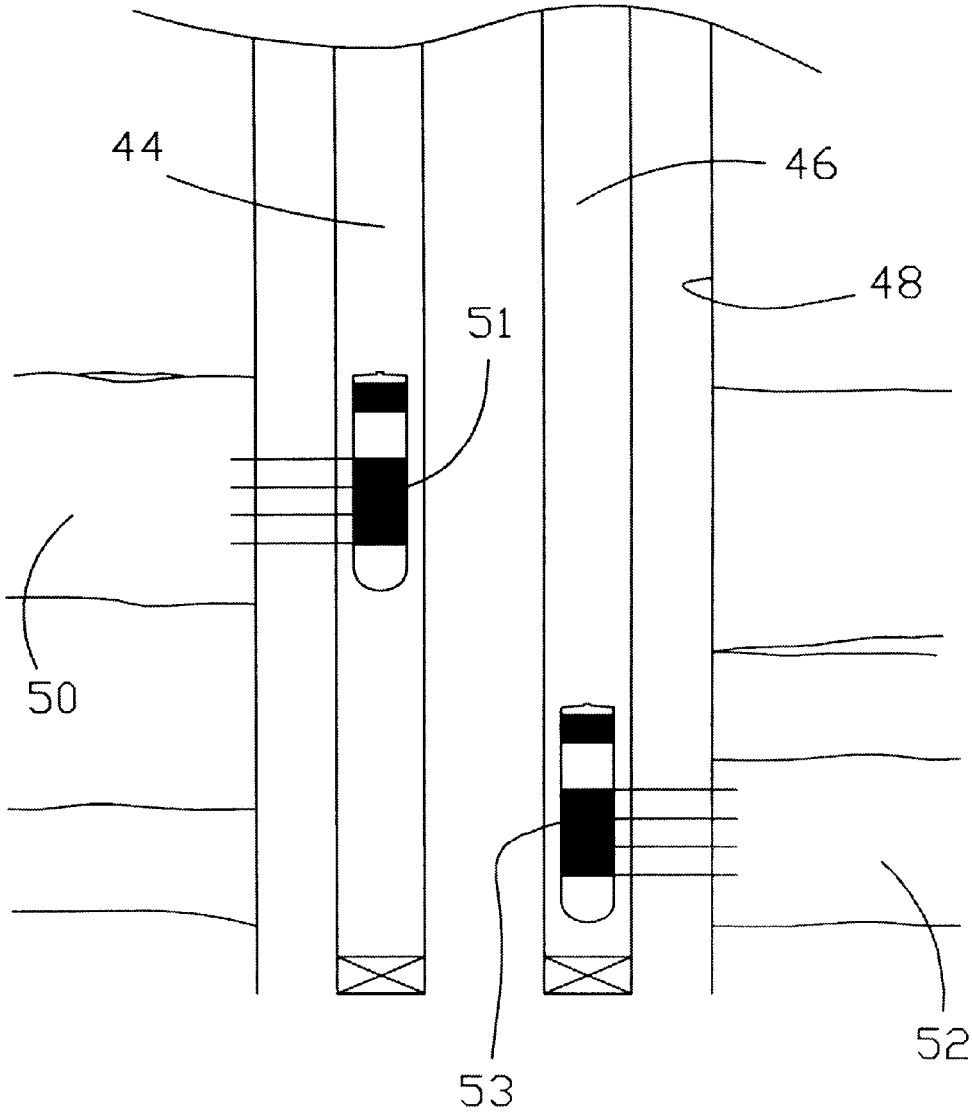
FIG. 11, is an elevational view, in cross-section, showing components of a monobore/tubingless completion having multiple production strings capable of producing multiple zones simultaneously and utilized in accord with the present invention.

Monobore/tubingless wells may typically utilize from 2⅜" to 9⅝" tubing/casing. Moreover, monobore/tubingless completions permit multiple production strings to be run in the same wellbore as indicated in FIG. 11 which shows two production strings 44 and 46 cemented in the same wellbore 48 producing simultaneously from two different production sands 50 and 52. As compared with standard types of completions, strings 44 and 46 would be surrounded by a production casing string and would require production packers. As shown in FIG. 11, tubular strings 44 and 46 are cemented into otherwise open hole 48. In accord with the present invention, production strings 44 and 46 may preferably each utilize a dual-screen assembly, such as dual-screen assemblies 51 and 53, respectively. There may be additional tubular strings, e.g. four tubular strings, and the completion may require directional perforation techniques and/or logging.

The present invention may be advantageously utilized in monobore/tubingless well completions to provide significant cost savings. Examples of typical uses of the present invention might include offshore wells that produce from sands which require some form of sand control. One very significant cost advantage in using the present invention is that the drilling/workover rig may be removed after the tubing/casing is run and cemented in the well. Limiting subsequent drilling/workover costs results in large cost savings.

Thus, as discussed hereinbefore, perforating adjacent lowest sand 54, installation of dual screen assembly 56 with lower screen 58, the desired blank tubular section 60, and upper screen 62, and frac packing may be accomplished without the use of the rig. After lowest sand 54 is depleted, recompletion of each other desired production formation, such as sand formations 64 and 66, require only mobilizing a lift boat. In the offshore case where a production platform exists that is large enough to handle skid-mounted wire line equipment, and/or relatively small equipment units, the cost of recompleting upper production formations, such as upper sands 64 and 66, is even more cost effective.

Basically, all that is needed to re-complete is to set a bridge plug at a predetermined depth, just as previously discussed in connection with FIG. 8 referring to through-tubing bridge plug 29. Likewise, as previously discussed in connection with FIG. 8, cement is positioned on the bridge plug such as cement 30 on bridge plug 29. For instance, a wire line dump bailer or other suitable means may be used to dump cement on top of the bridge plug. The next zone, such as zone 64 may then be perforated. A dual-screen assembly is then deployed adjacent the next zone and the next if frac packed. This process can be repeated as many times coming up the hole as there are production zones.

This invention is especially useful in areas where sand control is required which have small reserves that would not be economical for conventional completions/re-completions. Additional cost savings can result in completing high-pressure formations for monobore/tubingless well constructions whereby lower density completions fluids can be utilized as discussed hereinbefore. Subsurface valves or lubricators can also be utilized as discussed hereinbefore.

Note that in multi-tubular completions as indicated in FIG. 11, that each production tubular, such as tubulars 44 and 46, can be recompleted as discussed above. Therefore, multiple zones can be produced at once, and subsequent recompletions may permit any upper zones in the well to be completed at a low cost.

There are, and will be, variations on the completions discussed hereinbefore. For instance, different perforating guns and corresponding deployment means may be utilized. Different techniques may be utilized to run the dual screen assembly. The steps may be varied so that, for instance, larger diameter pressure actuated tubing conveyed guns might be run prior to running the production tubing. The guns and dual screen assembly may comprise a single unit. Different reservoir pressures and completion fluid weights may be utilized. Different methods may be utilized to clean the well to go to production depending on the well conditions. Thus, it will be understood that many additional changes in the details, materials, method steps, arrangement of parts, order of operation, and other details which have been herein described and which been illustrated in order to explain the basic nature of the invention and to set forth the presently preferred embodiments along with the above explanation of specific features of such preferred embodiments, may be made by those skilled in the art within the principle and scope of the invention as expressed in the appended claims.

What is claimed is:

1. A method of completing a well having a wellbore and one or more production zones comprising a first selected production zone with a first selected production zone formation pressure, said method comprising:

filling said wellbore with a completion fluid having a density such that a hydrostatic pressure of said completion fluid created within said wellbore adjacent said first production zone is less than said first production zone formation pressure;

providing a production packer above said first production zone;

installing production tubing within said well with a rig such that a bottom end of said production tubing is positioned above said first selected production zone;

applying an applied pressure to said wellbore such that a total pressure of said hydrostatic pressure and said applied pressure in said wellbore adjacent said first selected production zone is greater than or equal said first selected production zone formation pressure;

perforating said wellbore adjacent said first selected production zone;

positioning a dual-screen assembly in said wellbore adjacent said first selected production zone; and pumping fracturing slurry around said dual-screen assembly and into said first selected production zone with sufficient force to fracture said first selected production zone.

2. The method of claim 1, further comprising:

providing said production tubing with at least one subsurface valve positioned therein;

running a perforating gun through said production tubing;

pulling said perforating gun above said at least one subsurface valve after said step of perforating;

closing said at least one subsurface valve to maintain said total pressure in said wellbore adjacent said first selected production zone; and opening said at least one subsurface valve.

3. The method of claim 2, further comprising running said dual-screen assembly into said wellbore above said at least one subsurface valve while said at least one subsurface valve remains closed.

4. The method of claim 1, further comprising removing excess components of said fracturing slurry from said wellbore without use of coiled tubing.

5. The method of claim 4, further comprising utilizing said first selected production zone formation pressure to create fluid flow within said wellbore for removing excess components of said fracturing slurry from said wellbore.

6. The method of claim 1, further comprising moving said rig off said well after said step of running said production tubing and before said step of perforating.

7. The method of claim 1, wherein said one or more production zones include said first selected production zone and a second selected production zone at a well depth above said first selected production zone, whereby after said first selected production zone is to be shut off then said second selected production zone is to be brought into production, said second selected production zone having a second selected production zone formation pressure, said method further comprising:

said installing of said production packer further comprises positioning said production packer at a well depth above said first selected production zone and above said second selected production zone, and said installing of said production tubing within said well with said rig further comprises positioning said bottom end of said production tubing at a well depth above said first selected production zone and above said second selected production zone.

8. The method of claim 7, further comprising plugging off said first selected production zone at a well depth below said second selected production zone and above an uppermost perforation of said first selected production zone without utilizing a rig capable of pulling said production tubing.

9. The method of claim 7, further comprising filling said well with a second completion fluid having a density such that a hydrostatic pressure of said second completion fluid created within said wellbore adjacent said second selected production zone is less than said second selected production zone formation pressure.

10. The method of claim 7, further comprising perforating said second selected production zone without use of a rig capable of pulling said production tubing.

11. The method of claim 10, further comprising installing a second screen assembly adjacent said second selected production zone.

12. The method of claim 11, further comprising pumping fracturing slurry around said second screen assembly and into said second production zone with a sufficient pressure to fracture said second selected production zone.

13. A method of completing a well having a wellbore and one or more production zones comprising a first selected production zone with a first selected production zone formation pressure, comprising:

filling said wellbore with a completion fluid having a density less than about eleven pounds per gallon to thereby produce a hydrostatic pressure within said wellbore adjacent said first selected production zone;

installing production tubing within said well with a rig such that a bottom end of said production tubing is positioned at a well depth above said one or more production zones;

applying an applied pressure to said wellbore such that a total pressure of said hydrostatic pressure and said applied pressure in said wellbore adjacent said first selected production zone is greater than said first selected production zone formation pressure;

perforating said wellbore adjacent said first selected production zone;

positioning a dual-screen assembly in said wellbore adjacent said first selected production zone;

pumping fracturing slurry around said dual-screen assembly and into said first selected production zone.

14. The method of claim 13, further comprising removing excess components of said fracturing slurry above said dual-screen assembly from said wellbore without the use of coiled tubing.

15. The method of claim 14, wherein said step of removing excess components of said fracturing slurry from said wellbore without use of coiled tubing further comprises utilizing said first selected production zone formation pressure to create fluid flow within said wellbore for removing said excess components of said fracturing slurry from said wellbore.

16. The method of claim 13, wherein said one or more production zones include said first selected production zone and a second selected production zone at a well depth above said first selected production zone, whereby after said first selected production zone is to be shut off then said second selected production zone is to be brought into production, said second production zone having a second selected production zone formation pressure, said method further comprising filling said well with a second completion fluid having a density such that a hydrostatic pressure of said second completion fluid created within said wellbore adjacent said second selected production zone is less than said second selected production zone formation pressure.

17. The method of claim 16, further comprising installing a second dual screen assembly adjacent said second selected production zone without use of rig capable of pulling said production tubing.

18. The method of claim 17, further comprising pumping fracturing slurry around said second dual-screen assembly and into said second selected production zone with a sufficient pressure to fracture said second production zone.

19. The method of claim 13, further comprising said rig being mounted above said well for said step of installing said production tubing, and moving said rig off of said well such that said rig is not mounted above said well after said step of installing production tubing.

20. A method of completing a well having a wellbore and one or more production zones comprising a first selected production zone with a first selected production zone formation pressure, said well comprising a second production zone at a well depth above said first selected production zone, said second selected production zone having a second selected production zone formation pressure, whereby after said first selected production zone is to be shut off then said second selected production zone is to be brought into production, said method comprising:

positioning a production packer at a well depth above said first selected production zone and above said second production zone;

positioning a production tubing string within said well such that a bottom end of said production tubing is positioned at a well depth above said first selected production zone and above said second selected production zone;

perforating said wellbore adjacent said first selected production zone;

running a dual-screen assembly into said production string;

positioning said dual-screen assembly in said wellbore adjacent said first selected production zone; and pumping fracturing slurry through said production tubing around said dual-screen assembly and into said first selected production zone.

21. The method of claim 20, further comprising utilizing said first selected production zone formation pressure to create fluid flow within said wellbore for removing excess components of said fracturing slurry from said wellbore.

22. The method of claim 20, further comprising:

plugging off said first selected production zone at a well depth below said second production zone and above an uppermost perforation of said first selected production zone to thereby prevent all fluid flow from said first selected production zone;

perforating said second selected production zone without use of a rig capable of pulling said production tubing;

installing a second screen assembly adjacent said second production zone; and pumping fracturing slurry around said second screen assembly and into said second production zone with a sufficient pressure to fracture said second production zone.

23. The method of claim 20, further comprising:

providing said production tubing string with at least one subsurface valve;

pulling a perforating gun above said at least one subsurface valve within said production string after said step of perforating; and closing said at least one subsurface valve.

24. The method of claim 20, further comprising:

providing said production tubing string with at least one subsurface valve;

running a screen assembly into said production string above said valve while said valve remains closed; and opening said at least one subsurface valve.

25. A method for a monobore well completion wherein a well has one or more production zones comprising a first selected production zone with a first selected production zone formation pressure, said monobore well completion comprising at least one tubular string cemented in a wellbore such that said at least one tubular string has no production packer mounted therein, said method comprising:

perforating said at least one tubular string adjacent said first selected production zone;

running a dual-screen assembly into said at least one tubular string;

positioning said dual-screen assembly in said wellbore adjacent said first selected production zone within said at least one tubular string; and pumping fracturing slurry around said screen assembly and into said first selected production zone with sufficient force for fracturing said first selected production zone.

26. The method of claim 25 wherein said one or more production zones comprises said first selected production zone and a second selected production zone, said method further comprising:

plugging off said first selected production zone at a well depth below said second selected production zone and above an uppermost perforation of said first selected production zone after said first selected production zone is to be shut off;

perforating said at least one tubular string adjacent said first selected production zone;

installing a second screen assembly adjacent said second production zone; and pumping fracturing slurry around said second screen assembly and into said second selected production zone with a sufficient pressure to fracture said second selected production zone.

27. The method of claim 26, wherein said steps of plugging off, perforating, installing, and pumping, are performed without the use of a rig.

28. The method of claim 25, further comprising:

filling said wellbore with a completion fluid having a density such that a hydrostatic pressure of said completion fluid created within said wellbore adjacent said first production zone is less than said first selected production zone formation pressure; and applying an applied pressure to said wellbore such that a total pressure of said hydrostatic pressure and said applied pressure in said wellbore adjacent said first selected production zone is greater than or equal said first selected production zone formation pressure.

29. The method of claim 25 wherein said at least one tubular string comprises a first tubular string and a second tubular string, said method comprising:

installing a first dual-screen assembly in said first tubular string, installing a second dual-screen assembly in said second tubular screen, and producing simultaneously through said first tubular string and said second tubular string.

* * * * *